US005443875A

United States Patent [19]

Liu

[11] Patent Number: 5,443,875

[45] Date of Patent: Aug. 22, 1995

[54] LABEL PATCH FOR GARMENTS

[76] Inventor: Warren S. Liu, 7500 Lilla Pl., West Hills, Calif. 91304

[21] Appl. No.: 67,237

[22] Filed: May 25, 1993

[51] Int. Cl.[6] ..... B65C 5/00

[52] U.S. Cl. ..... 428/40; 2/46; 2/51; 2/115; 2/272; 40/299; 283/81; 283/101; 428/121; 428/126; 428/130; 428/192; 428/194; 428/212; 428/220

[58] Field of Search ..... 428/40, 41, 42, 192, 428/194, 343, 356, 201, 220, 124, 126, 213, 245, 261, 262, 130, 212, 91; 283/81, 101; 40/299; 2/46, 51, 115, 272

[56] References Cited

U.S. PATENT DOCUMENTS

| | | | |
|---|---|---|---|
| 1,320,692 | 11/1919 | Hulse | 428/126 |
| 1,707,515 | 4/1929 | Evans | 428/194 |
| 2,531,631 | 11/1950 | Jordan | 428/194 |
| 3,537,194 | 11/1970 | Engle | 428/126 |
| 3,752,304 | 8/1973 | Alef | 428/194 |

*Primary Examiner*—Nasser Ahmad
*Attorney, Agent, or Firm*—Sheldon & Mak

[57] ABSTRACT

Disclosed is a protective patch for smoothly covering labels in existing garments. The patch includes a flexible member formed of cotton flannel, and an adhesive material on the flexible member. The adhesive material forms a first adhesive that extends within a ring-shaped region proximate an edge margin of the flexible member, the first adhesive being releasable from the garment for exposing the label. A marginal portion of the flexible member is folded against a facing portion of the flexible member for forming a double thickness of the flexible member with the edge margin being spaced inwardly from an outer perimeter of the patch. A second adhesive secures the marginal portion to the facing portion, the marginal portion having a corner width at locations of minimum radius of the outer perimeter, the corner width being less than half of the minimum radius for limiting projections of the perimeter margin away from the facing flexible material. An outer perimeter of the patch has a minimum radius of not less than approximately 0.1 inch for avoiding high-pressure local contact of the patch against a wearer of the garment.

18 Claims, 1 Drawing Sheet

LABEL PATCH FOR GARMENTS

BACKGROUND

The present invention relates to garments, and more particularly to garments having sewn-in labels therein.

Many wearers of garments having sewn-in labels experience itching and other discomfort resulting from direct skin contact or indirect contact through thin undergarments. Sources of particular discomfort are labels that are made from relatively stiff material that is folded over and sewn into a seam of the garment. Another type of label is rectangular, having parallel seams at opposite ends, the end edge margins being folded under and sewn. This type of label is also irritating in that the folds at the corners of the label can protrude and cut into the skin. Many of such labels are found in collar seams of shirts and jackets, the labels making particularly irritating contact with the wearer's neck. This problem is especially acute for those having tender skin, especially infants and small children.

In these circumstances, many resort to cutting or tearing the labels from the garments. Unfortunately, the information of the label is lost from association with the garment upon removal of the label. The remnant or stump that remains when the label is cut can also be a source of irritation, and the garment is likely to be seriously damaged by tearing out the label. Moreover, tearing out a label can leave an unsightly remnant or stump of indefinite size that can remain as a source of irritation.

Thus there is a need for a system for alleviating the discomfort and irritation caused by labels that are sewn-in garments.

SUMMARY

The present invention meets this need by providing a non-irritating patch for smoothly covering labels in existing garments. In one aspect of the invention, the patch includes a flexible member and a ring-shaped adhesive member formed on the flexible member for affixing the patch onto the garment, the adhesive member extending only within a perimeter region of the flexible member for maintaining flexibility of the garment. Preferably a marginal portion of the flexible member is folded against a facing portion of the flexible member for forming a double thickness of the flexible member with the edge margin being spaced inwardly from an outer perimeter of the patch, a second adhesive securing the marginal portion to the facing portion.

Preferably the first adhesive is releasable from the garment for exposing the label. The first adhesive is preferably spaced from at least a portion of the outer perimeter for forming a tab portion of the patch, the tab portion facilitating removal of the patch. The first adhesive can be spaced from approximately 0.05 to approximately 0.10 inch from the outer perimeter.

Preferably the first adhesive is reusable for permitting replacement of the patch following exposure of the label. A single material can form the first adhesive and the second adhesive. The first adhesive can extend inwardly on the flexible material away from the marginal portion.

The marginal portion can have a corner width at locations of minimum radius of the outer perimeter, the corner width being less than half of the minimum radius for limiting projections of the perimeter margin away from the facing flexible material. The corner width can be less than approximately 10 percent of the minimum radius.

An outer perimeter of the patch can have a minimum radius that is less than approximately 0.1 inch for avoiding high-pressure local contact of the patch against a wearer of the garment. The minimum radius can be not less than approximately 0.2 inch. The outer perimeter can be generally rectangular. A portion of the outer perimeter can be semicircular. The flexible material can include cotton flannel.

DRAWINGS

These and other features, aspects, and advantages of the present invention will become better understood with reference to the following description, appended claims, and accompanying drawings, where:

DESCRIPTION

Figure 1:
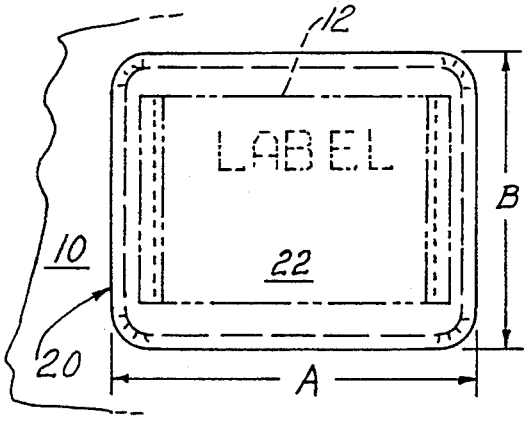
FIG. 1 is a front elevational view of a labeled garment portion having a protective patch affixed thereto according to the present invention.

The present invention is directed to a protective patch for protecting a wearer of garments from harmful contact with labels of the garments. With reference to FIGS. 1–4 of the drawings, a garment 10 having an inside label 12 is provided with a protective patch 20 according to the present invention. The patch 20 includes a flexible member 22 having suitable first adhesive 24 applied in a ring-shaped pattern proximate a marginal edge 25 thereof for affixing the patch 20 to the garment 10 with the label 12 being completely covered by the patch 20. Preferably the adhesive 24 surrounds the label 12 without contacting same for preventing loss of flexibility of the combination of the garment 10 and the patch 20 that would otherwise result from multiple layers of the combination being stiffly laminated by the first adhesive 24.

In an exemplary and preferred configuration of the invention, the patch 20 has a rounded rectangular shape of length A, width B, and corner radius R. A marginal portion 26 of the flexible member 22 is folded over, extending a distance C from a perimeter extremity 28 of the patch 20 for avoiding exposure of the wearer to raw edges of the edge extremity 28. Preferably the marginal portion 26 is secured in place by a suitable second adhesive 30. As shown most clearly in FIG. 4, the marginal portion 26 is gathered proximate corners 32 of the patch 20 as indicated at 34 for avoiding bulkiness of the patch 20 at the corners 32. Preferably the distance C is at least approximately 0.05 inch for facilitating formation and adhesion of the marginal portion 26, and not more than approximately 0.1 inch for avoiding unnecessary puckering of the edge margin 26 in regions of minimum perimeter radius of the patch 20, and for avoiding unnecessary stiffness of the patch 20 along the perimeter extremity 28. For example, the corner radius R is preferably not less than approximately 0.1 inch for avoiding concentrations of pressure against a wearer of the garment 10, the distance C being approximately 0.05 inch within regions the minimum corner radius. More preferably, the radius R is not less than approximately 0.2 inch, the distance C ranging between 0.05 and 0.1 inch.

Figure 2:
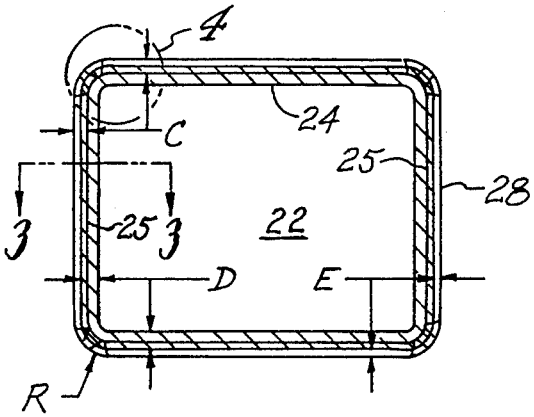
FIG. 2 is rear elevational view of the patch of FIG. 1.

As shown in FIG. 2, the first adhesive 24 is applied over an annular width D, extending to a distance E from the perimeter extremity 28. The first adhesive 24 is preferably non-permanent, the distance E providing a convenient small marginal tab portion of the patch 20 for facilitating removal of the patch 20 during laundering of the garment 10 or when it is desired to inspect the label 12. Suitably, the distance E can be from approximately 0.05 inch to approximately 0.1 inch for permitting grasping while maintaining structural integrity of the connection between the patch 20 and the garment 10.

Figure 3:
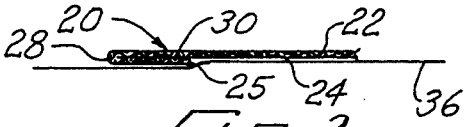
FIG. 3 is a detail sectional view of the patch of FIG. 1 on line 3—3 in FIG. 2.
Figure 4:
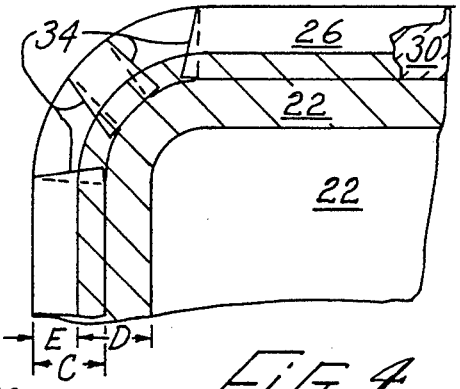
FIG. 4 is a detail elevational view of the patch of FIG. 1 within region 4 of FIG. 2.

A preferred material for the first adhesive 24 is also reusable, being available in glue stick form as Catalog 6307 from 3M Consumer Stationery Division of St. Paul, Minn. Preferably, and as shown in FIG. 3, the patch 20 is provided with a conventional peelable backing 36 for protecting the first adhesive 24.

Suitable materials for the flexible member 22 include soft, flexible woven fabrics and flexible plastic sheet having a thickness between approximately 0.001 inch and approximately 0.015 inch. A particularly preferred material for the flexible member 22 is soft cotton flannel. The Catalog 6307 adhesive or an equivalent thereof can also be used for the second adhesive 30. Preferably, however, the second adhesive 30 is stronger than the first adhesive 24 for holding the marginal portion 26 flatly folded during removal of the patch 20. Thus a preferred material for the second adhesive 30 is Dennison Glue Stick, available from Dennison Mfg. Co. of Framingham, Mass.

Figure 6:
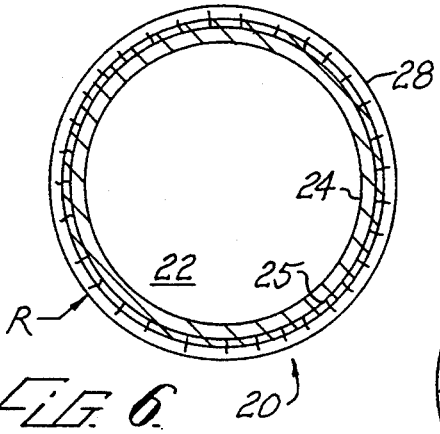
FIG. 6 is a rear elevational view showing another alternative configuration of the patch of FIG. 1.
Figure 5:
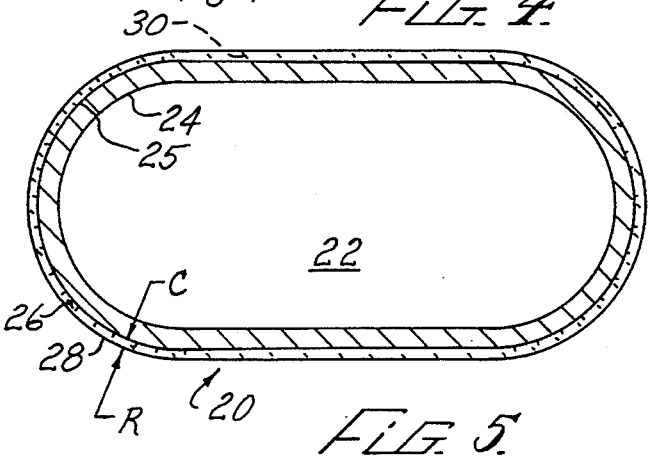
FIG. 5 is a rear elevational view as in FIG. 2, showing an alternative configuration of the patch of FIG. 1.

With further reference to FIGS. 5 and 6, the patch 20 can be made in a variety of shapes, including oval as shown in FIG. 5, and round as shown in FIG. 6, for forming protective coatings on rivets, snaps and the like, and/or decorative coatings. Further, and as shown in FIG. 5, the first adhesive 24 can extend inwardly from the marginal portion 26, the second adhesive 30 being of the same material and extending outwardly from the first adhesive 24, thereby facilitating fabrication of the patch 20 by permitting a single application of adhesive for forming the first adhesive 24 and the second adhesive 30.

In the configurations of the patch 20 as shown in FIGS. 5 and 6, the perimeter extremity 28 is semicircularly (or circularly) curved, so that the distance C is very small as compared with the radius R, being less than approximately 0.1 R so that there is substantially no puckering of the marginal portion 26.

Figure 7:
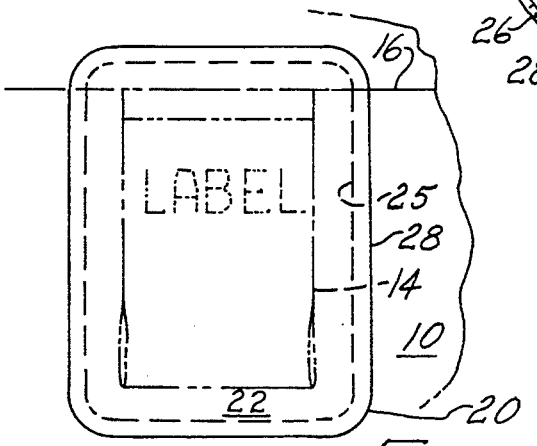
FIG. 7 is a plan view showing the patch of FIG. 1 applied to a differently labeled garment.

With further reference to FIG. 7, the patch 20 can be used for protecting against itching and discomfort from a label 14 having a loop configuration that extends from a seam 16 of the garment 10, the patch 20 extending on opposite sides of the seam 16.

Although the present invention has been described in considerable detail with reference to certain preferred versions thereof, other versions are possible. For example, The patch 20 can be generally triangular or any other geometric shape. Also, the dimension E can be equal to or greater than the dimension C. Therefore, the spirit and scope of the appended claims should not necessarily be limited to the description of the preferred versions contained herein.

What is claimed is:

1. A protective patch for smoothly covering a label in an existing garment, the patch comprising:

(a) a flexible member having a perimeter edge margin, entire perimeter edge marginal region of the flexible member being folded against a facing portion of the flexible member for forming a double thickness of the flexible member with the edge margin being spaced inwardly from an outer perimeter extremity of the patch; and (b) an adhesive material on the flexible member, the adhesive material forming a first adhesive on the flexible member within a ring-shaped region of the patch for affixing to the garment with the first adhesive surrounding but not contacting the label, an outer perimeter of the ring-shaped region extending proximate the perimeter extremity, a second adhesive securing only the marginal region to the facing portion, the marginal region having a corner width at locations of minimum radius of the outer perimeter extremity, the corner width being less than half of the minimum radius for limiting projections of the perimeter margin away from the facing flexible material, the minimum radius being not less than approximately 0.1 inch for avoiding high-pressure local contact of the patch against a wearer of the garment.

2. The patch of claim 1, wherein the first adhesive is releasable from the garment for exposing the label.

3. The patch of claim 2, wherein the first adhesive is spaced from at least a portion of the outer perimeter extremity for forming a tab portion of the patch, the tab portion facilitating removal of the patch.

4. The patch of claim 3, wherein the first adhesive is spaced from approximately 0.05 to approximately 0.10 inch from the outer perimeter extremity.

5. The patch of claim 2, wherein the first adhesive is reusable for permitting reuse of the patch following exposure of the label.

6. The patch of claim 2, wherein a single material forms the first adhesive and the second adhesive.

7. The patch of claim 7, wherein the first adhesive extends inwardly on the flexible material away from the marginal portion.

8. The patch of claim 1, wherein the corner width is less than approximately 10 percent of the minimum radius.

9. The patch of claim 1, wherein the minimum radius is not less than approximately 0.2 inch.

10. The patch of claim 1, wherein the outer perimeter extremity is generally rectangular.

11. The patch of claim 1, wherein a portion of the outer perimeter extremity is semicircular.

12. A protective patch for smoothly covering a label in an existing garment, the patch comprising:

(a) a flexible member formed of cotton flannel; and (b) an adhesive material on the flexible member, the adhesive material forming a first adhesive on the flexible member within a ring-shaped region of the patch for affixing to the garment with the first adhesive surrounding but not contacting the label, the ring-shaped region extending to proximate an outer perimeter extremity of the patch, the first adhesive being releasable from the garment for exposing the label, an entire perimeter marginal portion of the flexible member being folded against a facing portion of the flexible member for forming a double thickness of the flexible member with the edge margin being spaced inwardly from the outer perimeter extremity, a second adhesive securing only the marginal region to the facing portion, the marginal region having a corner width at locations of minimum radius of the outer perimeter extremity, the corner width being less than half of the minimum radius for limiting projections of the perimeter margin away from the facing flexible material, the minimum radius being not less than approximately 0.1 inch for avoiding high-pressure local contact of the patch against a wearer of the garment.

13. The patch of claim 12, wherein the first adhesive is spaced from at least a portion of the outer perimeter extremity for forming a tab portion of the patch, the tab portion facilitating removal of the patch.

14. The patch of claim 13, wherein the first adhesive is spaced from approximately 0.05 to approximately 0.10 inch from the outer perimeter extremity.

15. The patch of claim 12, wherein the first adhesive is reusable for permitting reuse of the patch following exposure of the label.

16. The patch of claim 12, wherein the minimum radius is not less than approximately 0.2 inch.

17. The patch of claim 12, wherein the outer perimeter extremity is generally rectangular.

18. The patch of claim 12, wherein a portion of the outer perimeter extremity is semicircular.

* * * * *